United States Patent [19]

Hansen et al.

[11] Patent Number: 4,979,533

[45] Date of Patent: Dec. 25, 1990

[54] ADJUSTABLE ORTHOPEDIC CRUTCH

[75] Inventors: Ries B. Hansen, River Hills; Howard G. Morter, Cedarburg, both of Wis.

[73] Assignee: Triad Technologies, Inc., Milwaukee, Wis.

[21] Appl. No.: 297,519

[22] Filed: Jan. 17, 1989

[51] Int. Cl.[5] ..... A61H 3/02

[52] U.S. Cl. ..... 135/69; 135/72

[58] Field of Search ..... 135/68, 69, 72

[56] References Cited

U.S. PATENT DOCUMENTS

| | | | |
|---|---|---|---|
| Re. 32,815 | 1/1989 | Smith | 135/69 |
| 2,172,047 | 9/1939 | Jacobuci | 135/69 |
| 2,264,015 | 11/1941 | Bennett | 135/69 |
| 2,544,957 | 3/1951 | Henry | 135/69 |
| 3,730,198 | 5/1973 | Johnston | 135/69 |
| 3,768,495 | 10/1973 | Smith | 135/69 |

*Primary Examiner*—Henry E. Roduazo

*Attorney, Agent, or Firm*—C. Thomas Sylke; Arnold J. Ericsen

[57] ABSTRACT

An adjustable crutch has two vertical supports with an upper arm rest and a third, vertically adjustable lower support. The lower supports fixes the overall height of the crutch. The independently moved hand grip is easily adjustable to provide proper spacing between the crutch's hand grip and arm rest based on the user's arm length. This contruction requires only a two-step adjustment process which may be accomplished individually by the user.

18 Claims, 1 Drawing Sheet

ADJUSTABLE ORTHOPEDIC CRUTCH

BACKGROUND OF THE INVENTION

1. Field of the Invention

The present invention relates generally to the art of orthopedic crutches to assist injured and handicapped individuals. More specifically, the present invention relates to an improved adjustable orthopedic crutch.

2. Description of Related Areas of Art

While Applicant is unaware of any configuration either identical to this crutch design or able to be adjusted as easily as the construction claimed herein, numerous adjustable crutches have been developed over time which allow the crutch to be adjusted to the height and other physical characteristics of the person using the crutch. These earlier devices, however, have required more complex adjustment mechanisms and procedures to accomplish adjustment. In fact, some of these devices required more than one person to perform the adjustment, or required someone to assist the injured person in accomplishing adjustment.

OBJECTS AND SUMMARY OF THE INVENTION

It is a primary object of the present invention to provide a simple, adjustable crutch which can be adjusted by an injured person without assistance.

It is another important object of the present invention to provide an adjustable crutch which may be easily manufactured and assembled.

It is still another object of the present invention to provide an adjustable crutch which may be adjusted without as many procedural steps as earlier devices.

How these and further objects of the invention are accomplished will be described by reference to the following description of the preferred embodiment of the invention taken in conjunction with the FIGURES. Generally, however, the objects are accomplished in an adjustable crutch having two vertical supports with an upper armrest and a third, vertically adjustable lower support. The lower support fixes the overall height of the crutch. A unique hand grip is easily adjustable to provide proper spacing between the crutch's hand grip and armrest based on the user's arm length. This configuration reduces crutch adjustment to a simple, two-step process.

Other variations and modifications, as well as different applications of the invention may become apparent to those skilled in the art after reading the specification, and are deemed to fall within the scope of the present invention if they fall within the scope of the claims which follow the description of the preferred embodiment.

DESCRIPTION OF THE DRAWINGS

In the FIGURES, like reference numerals are used to indicate like components.

DETAILED DESCRIPTION OF THE PREFERRED EMBODIMENT

Figure 1:
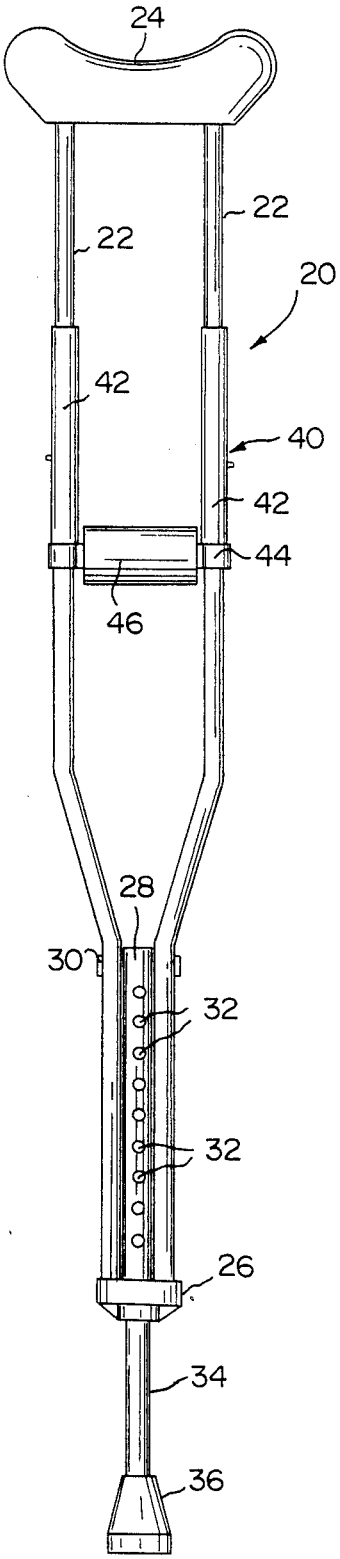
FIG. 1 is a plan view of a crutch of the present invention.

The preferred embodiment of an adjustable orthopedic crutch 20 is shown in FIG. 1. Crutch 20 has two vertical supports 22 which are circular in cross-section. At their upper ends, supports 22 are rigidly held in place by an armrest 24. At their lower ends, supports 22 are rigidly held by brackets 26 and 28. Armrest 24 is designed to comfortably accommodate the user's underarm when the crutch is in use.

Lower bracket 26 holds vertical supports 22 in place as well as holding tubular bracket 28 rigidly in place between supports 22. At its upper end, tubular bracket 28 is held in place by a rivet 30 passing between and through supports 22. As seen in FIG. 1, tubular bracket 28 has a plurality of holes 32 therethrough.

Tubular bracket 28 provides support and a guide for lower support 34. The bottom of a lower support 34 is covered with a frictional pod 36 designed to enhance stability and decrease slippage of the crutch when it is in use. Support 34 is held in place in bracket 28 by means of a spring loaded button which is not shown in detail. The button holding lower support 34 in place is generally similar to button 50 described below in connection with the adjustable hand grip of the present invention. By depressing the button on support 34, one may slide support 34 to a preselected position within bracket 28, thereby altering the overall length of the crutch 20.

Figure 2:
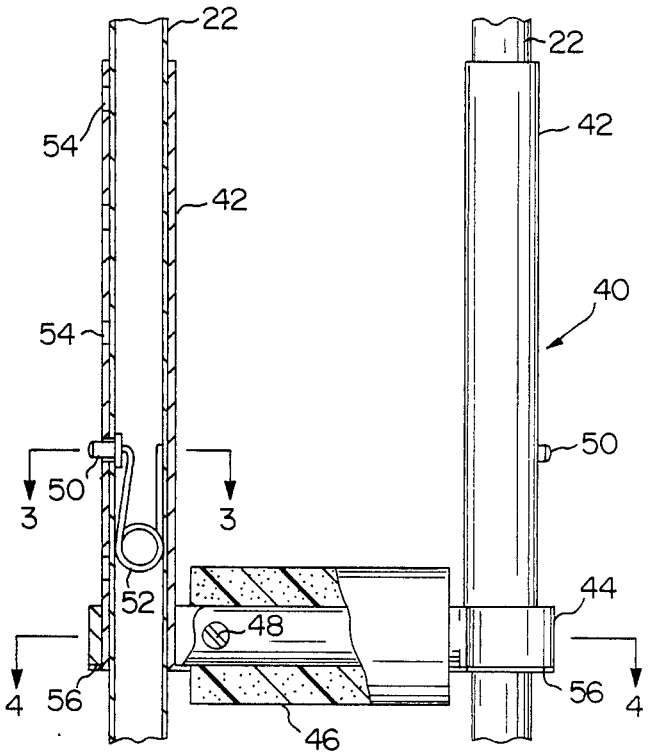
FIG. 2 is an exploded view of the adjustable grip mechanism of the present invention.
Figure 3:
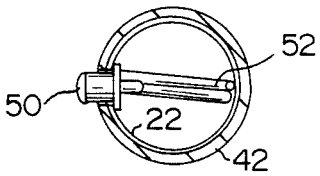
FIG. 3 is a cross-sectional view of the locking mechanism of the adjustable hand grip of the present invention taken along the line 3—3 of FIG. 2.
Figure 4:
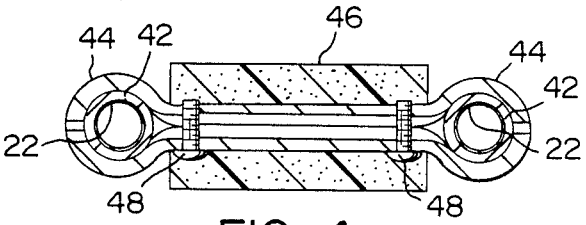
FIG. 4 is a cross-sectional view of the hand grip of the adjustable crutch in the present invention taken along the line 4—4 of FIG. 2.

A novel adjustment mechanism 40 for crutch 20 includes two tubular sleeves 42 which are slidable over supports 22. FIG. 2 illustrates mechanism 40 in more detail, also showing the internal workings of the adjustment mechanism 40. Sleeves 42 are attached to one another by a hand grip bracket 44 over which a sponge rubber grip 46 may be placed. Brackets 44 are held together by screws 48 and rigidly hold sleeves 42 in a fixed orientation.

Mechanism 40 is held in place on supports 22 by means of two locking buttons 50, each of which is located in one of the supports 22. Button 50 is also used in maintaining the vertical position of lower support 34, as mentioned above. Locking button 50 is biased outwardly from support 22 by a spring 52, as seen in FIG. 2. Button 50 engages one of the holes 54 located in adjustment mechanism 40.

Annular flange 56 prevents bracket 44 from slipping downward and off of sleeves 42 when mechanism 40 is in a locked position. Compression forces from screws 48 and support from flange 56 ensure that hand grip brackets 44 do not move during use or adjustment of crutch 20.

OPERATION

When a person is fitted with crutch 20, only two adjustments need be made to properly fit the crutch to a given user's physical characteristics. First, lower support 34 is adjusted within tubular bracket 28 so that armrest 24 fits snuggly, yet comfortably, in the user's underarm. Then, locking buttons 50 are depressed on adjustment mechanism 40 and the hand grip either lowered or raised to the proper level for the user's hand. This distance is based on the person's arm length which can vary dramatically, even among people who are the same height.

The construction of crutch 20 avoids problems experienced in the past with crutches wherein the overall height would be set and the hand grip had to be adjusted by removing a screw that passed through both vertical supports and the hand grip and adjusted manually by repositioning the screw elsewhere in the crutch. In other prior constructions, the hand grip was in a set position and the underarm rest had to be adjusted along with the lower support to achieve the proper proportions for comfortable and effective use of the crutch. Applicant has, therefore, reduced the adjustment process to two easy steps which may be accomplished quickly and without the need of assistance for the injured person.

Variations, modifications and other applications may become apparent to those skilled in the art. Therefore, the above description of the preferred embodiment is to be viewed as illustrative rather than limiting. The scope of the present invention is limited only the scope of the claims that follow.

What is claimed is:

1. An adjustable orthopedic crutch comprising:

(a) first and second generally parallel, vertical tubular supports rigidly attached to one another;

(b) an arm support attached to the upper ends of said first and second tubular supports;

(c) a third vertical support between and parallel to the lower ends of said first and second supports, said third support being vertically movable;

(d) means for locking said third support in a preselected vertical position between said first and second supports;

(e) first and second tubular sleeves rigidly attached to one another by hand grip means, said first sleeve extending upward and externally from said hand grip means coaxially with said first support and being slidable over an intermediate portion of said first support, said second sleeve extending upward and externally from said hand grip means coaxially with said second support and being slidable over an intermediate portion of said second support; and (f) means positioned at discrete locations along said sleeve for locking said sleeves in a preselected vertical positions on said first and second supports and absorbing forces applied parallel to the axes of said supports.

2. The crutch of claim 1 wherein said locking means for said third support includes a tubular bracket mounted between said first and second supports, said third being slidably movable and lockable within said tubular bracket.

3. The crutch of claim 1 wherein said locking means for said third support further includes a third, spring-biased locking button engaging said third support and said tubular bracket.

4. The crutch of claim 1 wherein said locking means for said sleeves includes a first, spring-biased locking button engaging said first support and said first sleeve, and a second, spring-biased locking button engaging said second support and said second sleeve.

5. The crutch of claim 1 wherein said hand grip means includes first and second members clamped to said sleeves and means for clamping said members together and to said sleeves.

6. The crutch of claim 1 further comprising a friction pod attached to the bottom of said third support to assist in maintaining stability of the crutch when in use.

7. The crutch of claim 1 wherein each of said first and second tubular sleeves includes means for absorbing vertical forces applied at said hand grip means and generally parallel to said sleeves and said vertical tubular supports.

8. An adjustable orthopedic crutch comprising:

(a) first and second generally parallel, vertical tubular supports rigidly attached to one another;

(b) an arm support attached to the upper ends of said first and second tubular supports;

(c) a third vertical support between and parallel to the lower ends of said first and second supports, said third support being vertically movable;

(d) means for locking said third support in a preselected vertical position between said first and second supports;

(e) first and second tubular sleeves rigidly attached to one another by hand grip means, said first sleeve being slidable over an intermediate portion of said first support, said second sleeve being slidable over an intermediate portion of said second support, wherein said hand grip means includes first and second members clamped to said sleeves and means for clamping said members together and to said sleeves comprising a plurality of screws joining said members and wherein said members engage a lip on said sleeves to prevent downward movement of said hand grip means on said sleeves; and (f) means for locking said sleeves in a preselected vertical position on said first and second supports.

9. An adjustable orthopedic crutch comprising:

(a) first and second generally parallel, vertical tubular supports rigidly attached to one another;

(b) an arm support attached to the upper ends of said first and second tubular supports;

(c) a third vertical support between and parallel to the lower ends of said first and second supports, said third support being vertically movable;

(d) means for locking said third support in a preselected vertical position between said first and second supports;

(e) first and second tubular sleeves rigidly attached to one another by hand grip means, said first sleeve being slidable over an intermediate portion of said first support, said second sleeve being slidable over an intermediate portion of said second support; and (f) means for locking said sleeves in a preselected vertical position on said first and second supports;

wherein each of said first and second tubular sleeves includes means for absorbing vertical forces applied at said hand grip means and generally parallel to said sleeves and said vertical tubular supports; and wherein said force absorbing means includes a lip on each of said sleeves to prevent downward movement of said hand grip means on said sleeves.

10. The crutch of claim 9 wherein said hand grip means comprises first and second members clamped to said sleeves and means for clamping said members together and to said sleeves.

11. The crutch of claim 10 wherein said clamping means is a plurality of screws adjoining said members.

12. The crutch of claim 11 wherein said hand grip further comprises a sponge rubber grip cover generally enclosing said members.

13. The crutch of claim 12 wherein said locking means for said sleeves includes a first, spring-biased locking button engaging said first support and said first sleeve, and a second, spring-biased locking button engaging said second support and said second sleeve.

14. The crutch of claim 13 wherein said locking means for said third support includes a tubular bracket mounted between said first and second supports, said third support being slidably movable and lockable within said tubular bracket, and a third, spring-biased locking button engaging said third support and said tubular bracket; and further wherein a friction pod is attached to the bottom of said third support to assist in maintaining stability of the crutch when in use.

15. The crutch of claim 6 wherein said hand grip further comprises a sponge rubber grip cover generally enclosing said members.

16. The crutch of claim 15 wherein said locking means for said sleeves includes a first, spring-biased locking button engaging said first support and said first sleeve, and a second, spring-biased locking button engaging said second support and said second sleeve.

17. The crutch of claim 16 wherein said locking means for said third support includes a tubular bracket mounted between said first and second supports, said third support being slidably movable and lockable within said tubular bracket, and a third, spring-biased locking button engaging said third support and said tubular bracket; and further wherein a friction pod is attached to the bottom of said third support to assist in maintaining stability of the crutch when in use.

18. An adjustable orthopedic crutch comprising:

first and second generally parallel, vertical tubular supports rigidly attached to one another;

an arm support attached to the upper ends of said first and second tubular supports;

a third vertical support between and parallel to the lower ends of said first and second supports, said third support being vertically movable;

first and second tubular sleeves rigidly attached to one another by hand grip means, said first sleeve being slidable over an intermediate portion of said first support, said second sleeve being slidable over an intermediate portion of said second support;

said hand grip means including:

first and second members clamped to said sleeves and to each other by a plurality of screws;

a sponge rubber grip cover generally enclosing said members;

wherein said members engage a lip on said sleeves to prevent downward movement of said hang grip means on said sleeves;

means for locking said sleeves in a preselected vertical position on said first and second supports, said locking means comprising:

a first spring-biased locking button engaging said first support and said first sleeve;

a second spring-biased locking button engaging said second support and said second sleeve;

a tubular bracket mounted between said first and second supports, said third support being slidably movable and lockable within said tubular bracket; and a friction pod attached to the bottom of said third support to assist in maintaining stability of the crutch when in use.

* * * * *